US005613881A

United States Patent [19]

Ichida et al.

[11] Patent Number: 5,613,881

[45] Date of Patent: Mar. 25, 1997

[54] CONNECTOR

[75] Inventors: Kiyofumi Ichida; Osamu Sasai, both of Yokkaichi, Japan

[73] Assignee: Sumitomo Wiring Systems, Ltd., Yokkaichi, Japan

[21] Appl. No.: 410,057

[22] Filed: Mar. 24, 1995

[30] Foreign Application Priority Data

Apr. 8, 1994 [JP] Japan ..... 6-095829

[51] Int. Cl.[6] ..... H01R 13/64

[52] U.S. Cl. ..... 439/680; 439/374

[58] Field of Search ..... 439/374, 376, 439/378, 680, 681, 677

[56] References Cited

U.S. PATENT DOCUMENTS 4,659,162 4/1987 Cartesse ..... 439/374
4,898,543 2/1990 Benze ..... 439/374
4,921,448 5/1990 Endo et al. ..... 439/595
4,960,387 10/1990 Davis et al. ..... 439/374
5,425,650 6/1995 Maeda ..... 439/680

*Primary Examiner*—Hien D. Vu
*Attorney, Agent, or Firm*—Anthony J. Casella; Gerald E. Hespos

[57] ABSTRACT

A male connector 20 includes a male connector housing 22 formed with a multitude of cavities 21, and male terminals 23 mounted in the corresponding cavities 21. A female connector 10 includes a female connector housing 12 and female terminals mounted in the female connector housing 12. A pair of ribs 15 project from the opposite lateral sides of the leading end of the female connector housing 12 to prevent erroneous insertion of the female connector housing. Guide grooves 27 engageable with the ribs 15 are formed in a receptacle 24. Stepped portions 28 are formed on opposed inner wall surfaces of the receptacle 24 in positions higher (more toward the opening edge of the receptacle 24) than the male terminals 23. The obliquely inserted female connector housing 12 comes into contact with the stepped portions 28 and thereby any further entry thereof is blocked.

4 Claims, 5 Drawing Sheets

CONNECTOR

BACKGROUND OF THE INVENTION

1. Field of the Invention

The present invention relates to a connector which establishes connection by inserting a female connector housing into a receptacle of a male connector housing.

2. Description of the Prior Art

The following connector is known as being of the above type. As shown in FIGS. 6 and 7, a prior art male connector 1 includes a male connector housing 2 having a receptacle 2*a* and a multitude of male terminals 3 retained in the male connector housing 2. The terminals 3 project into the interior of the receptacle 2*a*. On the other hand, as shown in FIGS. 8 and 9, a prior female connector 4 includes a female connector housing 5 which is insertable into the receptacle 2*a* and a multiple of female terminals which are to be engaged and connected with the corresponding male terminals 3. A pair of ribs 6 project at opposite lateral sides of the female connector housing 5 so as to avoid erroneous insertion, and guide grooves 7 engageable with the corresponding ribs 6 are formed in the receptacle 2*a*. This arrangement prevents the female connector housing 5 from being inserted into the receptacle 2*a* in a wrong direction or obliquely as shown in FIG. 8.

However, even with the ribs 6 formed as described above, if the female connector housing 5 is forcibly inserted, the receptacle 2*a* undergoes elastic deformation, thereby allowing entry of the female connector housing 5. Then, a corner portion of the female connector housing 5 comes into contact with some of the female terminals 3 in the receptacle 2*a*, causing deformation of these terminals 3. As a result, such forcible insertion damages the connector.

In view of the above problem, it is an object of the invention to prevent a damage of a connector resulting from wrong insertion of a female connector housing.

SUMMARY OF THE INVENTION

If the female connector housing in accordance with the subject invention is forcibly inserted into the receptacle of the subject invention, it forces its entry into the receptacle while causing the receptacle to open wider. However, the female connector housing entered into the receptacle comes into contact with a stepped portion formed on the inner wall surface of the receptacle and thereby its further entry is blocked, with the result that contact of the female connector housing with the male terminals can be prevented.

According to a preferred embodiment, when the female connector housing in its proper posture is fitted into the receptacle of the male connector housing, a rib is engaged with a guide groove formed in the receptacle, thereby allowing insertion of the female connector housing. When the female connector housing in its reverse or upside-down posture is fitted into the receptacle, the rib is not engageable with the guide groove and thus the female connector housing cannot be inserted into the receptacle. Further, when the female connector housing is obliquely inserted into the receptacle, the rib is not in complete engagement with the guide groove. Accordingly, unless the posture is corrected, the female connector housing cannot be inserted into the receptacle.

As described above, according to the inventive connector, erroneous insertion can be prevented by allowing entry of the female connector housing only in its proper posture into the receptacle. Even if the female connector housing in its improper posture is forcibly inserted into the receptacle, it comes into contact with the stepped portion formed in the receptacle and thereby its further entry is blocked. Thus, deformation of the male terminals can be securely prevented.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
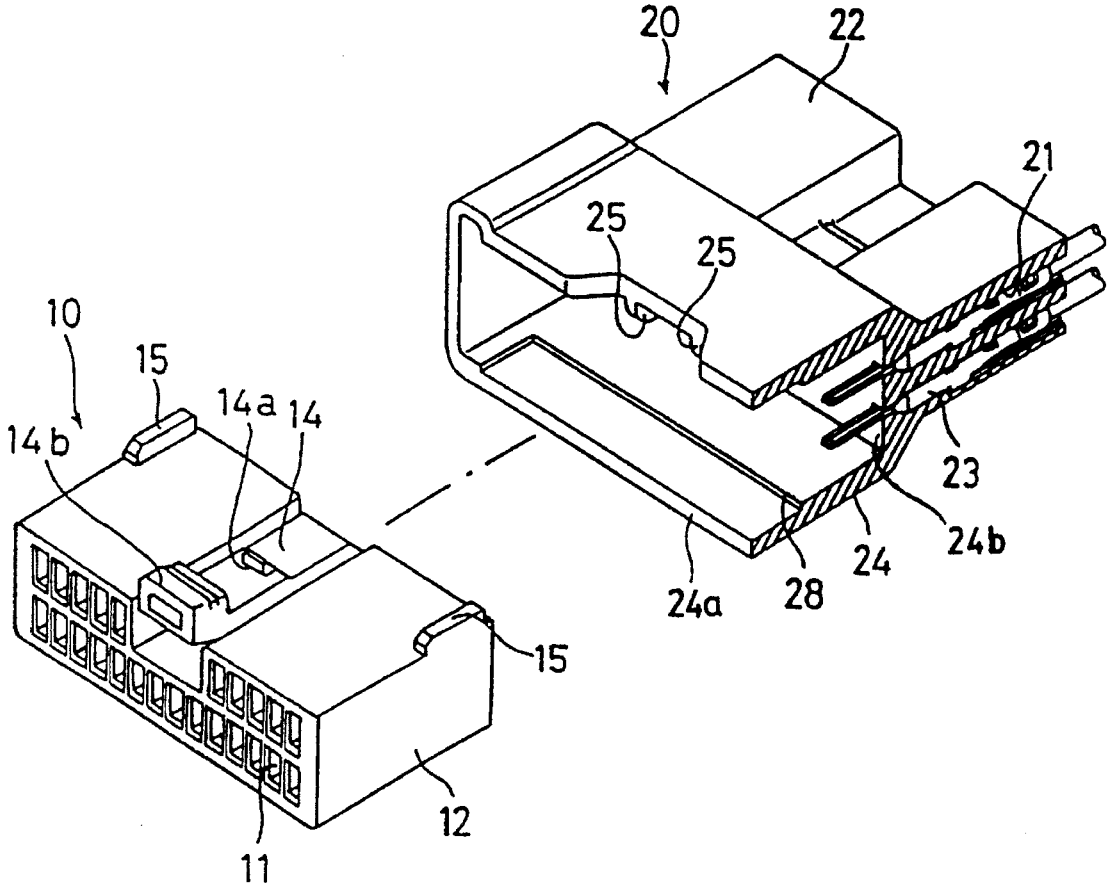
FIG. 1 is an overall perspective view of a connector according to the invention with a male connector partially in section.
Figure 2:
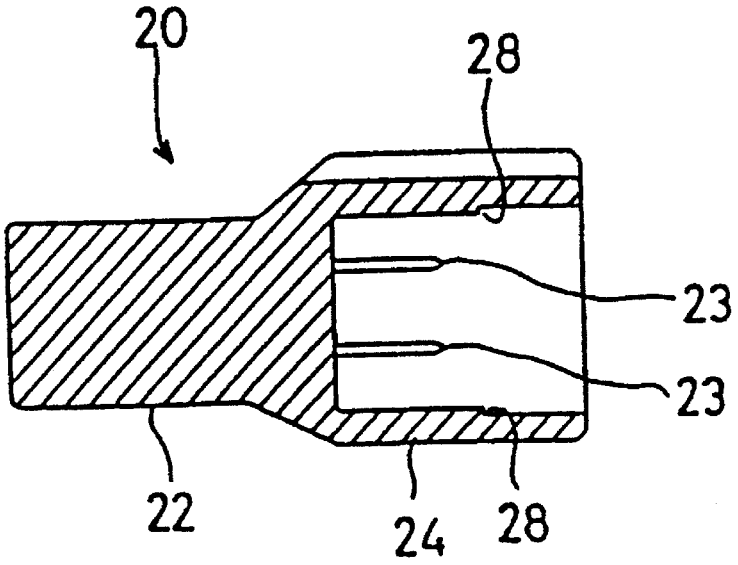
FIG. 2 is a section of the male connector.
Figure 3:
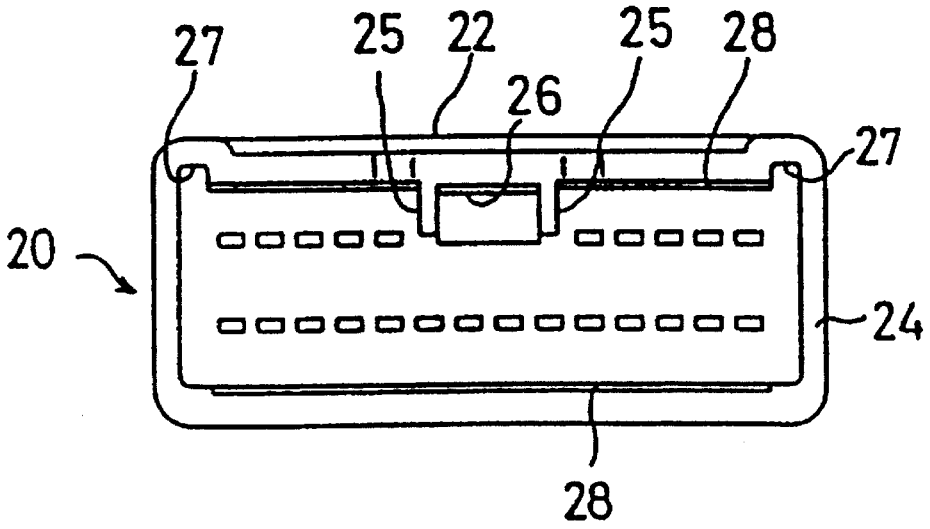
FIG. 3 is a front view of the male connector.

Hereafter, one embodiment according to the invention is described with reference to FIGS. 1 to 5.

A female connector 10 has a known structure including a flat and rectangular female connector housing 12 of synthetic resin which is formed with a multitude of cavities 11, and female terminals (not shown) lockingly mounted in the corresponding cavities 11. The female connector housing 12 is unitarily formed in an intermediate portion of one side surface thereof with an elastic locking member 14 engageable with an engaging claw 26 formed in a male connector housing 22. The locking member 14 is fixed only at one end at the leading end of the female connector housing 10. Further, a pair of ribs 15 project at opposite lateral sides of the leading end of the surface where the locking member 14 is formed. The ribs 15 act to prevent erroneous insertion of the female connector housing 12 into the male connector housing 22 and extend in a forward to rearward direction.

Similar to the female connector 10, the male connector 20 includes a male connector housing 22 of synthetic resin which is formed with a multitude of cavities 21 and male terminals 23 lockingly mounted in the corresponding cavities 21. The male connector 20 is unitarily formed at its leading end with a rectangular receptacle 24 into which the female connector housing 12 is insertable The receptacle 24 includes an opening edge 24*a* and a rear wall 24*b* from which the male terminals 23 project. A pair of guide ribs 25 project on one inner wall surface of the receptacle 24 which is to face the locking member 14 of the female connector housing 12 such that the ribs 25 are located at opposite lateral sides of the locking member 14 when the female connector housing 12 is inserted into the receptacle 24. An engaging claw 26 (see FIG. 3) that is engageable with the locking member 14 of the female connector housing 12 projects between the guide ribs 25 and 25. When the female connector housing 12 is completely inserted into the receptacle 24, a locking portion 14*a* of the locking member 14 is engaged with the engaging claw 26, with the result that female and male connectors 10 and 20 are locked to achieve an electrical connection. In order to release the above locking state and to detach the connectors 10 and 20 from each other, a pressing portion 14*b* formed at the leading end of the locking member 14 may be pressed so that the leading end of the locking member 14 is elastically deformed to move closer to the female connector housing 12.

In the receptacle 24 of the male connector 20, guide grooves 27 along which the corresponding ribs 15 are engaged and inserted are formed at the opposite lateral sides of the surface where the guide ribs 25 are formed. The guide grooves 27 extend straight along the depth direction of the receptacle 24. Steps 28 are formed on the inner wall surface of the receptacle 24 and parallel to the opening edge 24*a* of the receptacle 24. One step 28 extends continuously between the guide grooves 27. Another step 28 extends continuously across an opposed inner wall surface of the receptacle 24 opposite the surface on which the guide grooves 27 are formed. Each step 28 is located at a specified distance from the rear wall 24*b* of the receptacle 24, i.e., in a position higher (more toward the opening edge 24*a* of the receptacle 24) than the leading ends of the male terminals 23. The steps 28 are formed such that portions of the receptacle 24 between the steps 28 and the rear wall 24*b* define a smaller cross-section than portions of the receptacle 24 nearer the opening edge 24*a*. Hence, the steps 28 act as projection with which the female connector housing 12 obliquely inserted through the opening of the receptacle 24 comes into contact. It should be appreciated that a distance between these opposed inner wall surfaces below the stepped portions 28 (as indicated by dimension "a" in FIG. 1 at the bottom part of the receptacle 24) is slightly larger than the thickness "b" of the female connector housing 12, so that the female connector housing 12 can be inserted to the bottom of the receptacle 24 if the connectors 10 and 20 are properly aligned as shown in FIG. 1.

Next, the action of this embodiment is described. When the female connector 10 is held in a proper posture with respect to the male connector as in positional relationship shown in FIG. 1, the ribs 15, 15 are opposed straight to the corresponding guide grooves 27, 27 and thus the female connector 10 can be readily inserted into the receptacle 24. Thereby, the male terminals 23 of the male connector 20 are engaged with the female terminals of the female connector 10 and the connectors 10 and 20 are connected with each other.

When the female connector 10 is inverted with respect to the male connector 20 from the posture shown in FIG. 1, the ribs 15, 15 are not aligned with the guide grooves 27, 27. Thus, if an attempt is made to insert the inverted female connector 10 into the receptacle 24, the ribs 15, 15 come into contact with the opening edge 24*a* of the receptacle 24 opposite the guide grooves 27. Thus of the female connector 10 is impossible and erroneous insertion is avoided.

Figure 9:
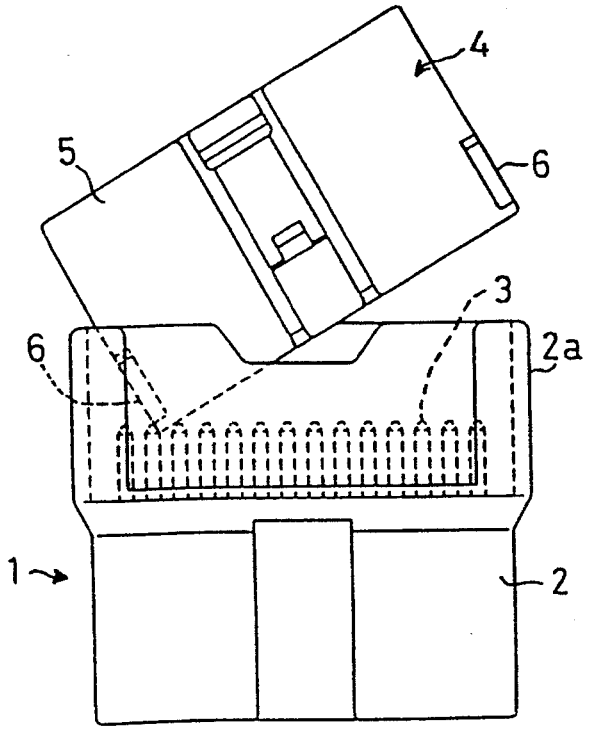
FIG. 9 PRIOR ART
FIG. 9 is a side view of the prior art connector when the female connector is obliquely inserted into the receptacle.

There are cases where a prior art female connector 10 is obliquely held with respect to a prior art receptacle 24 although its vertical posture is proper (is not turned upside down) and may be forcibly inserted into the receptacle 24. In this case, the receptacle 24 is forced to undergo elastic deformation to open wider in prior art connectors. As a result, the prior art female connector 10 is inserted deep enough to damage the male terminals 23 (see FIG. 9).

Figure 4:
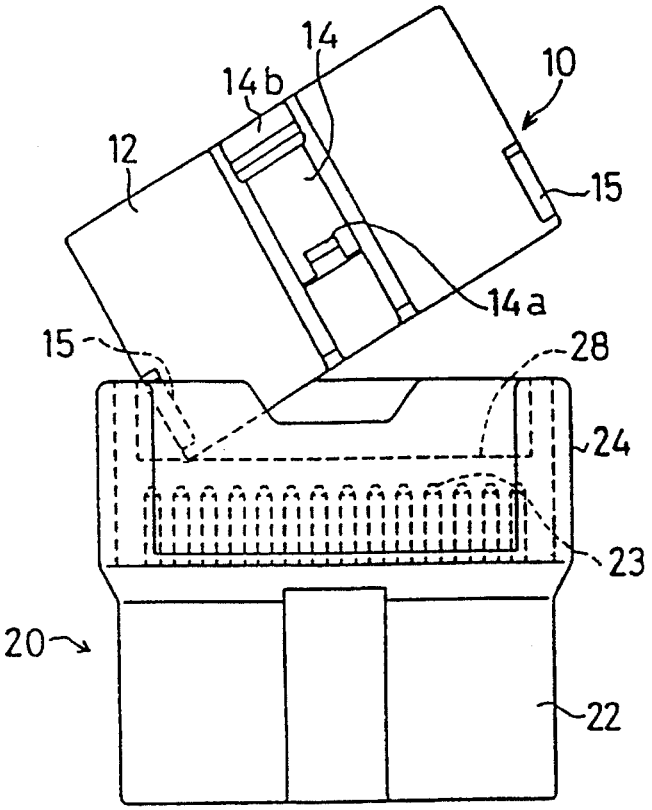
FIG. 4 is a side view showing a state where the female connector housing is obliquely inserted.
Figure 5:
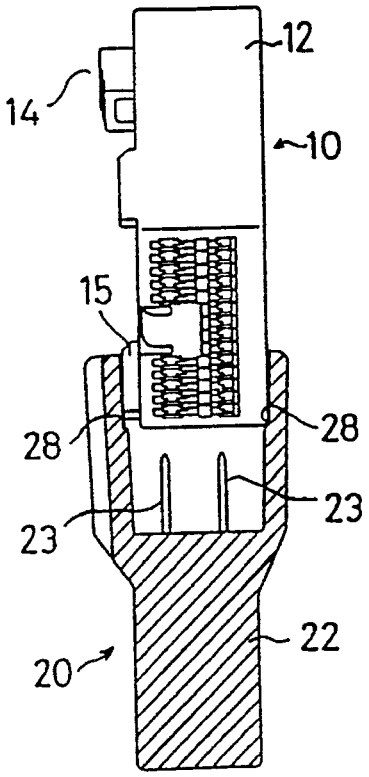
FIG. 5 is a partial section showing the state where the female connector housing is obliquely inserted.
Figure 6:
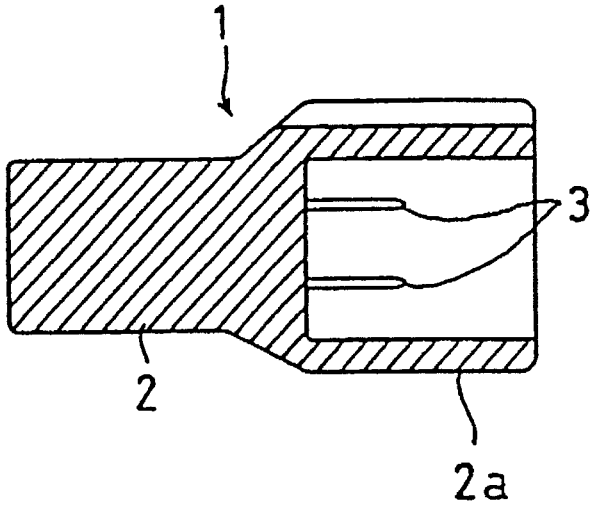
FIG. 6 PRIOR ART
FIG. 6 is a section of a prior art male connector.
Figure 7:
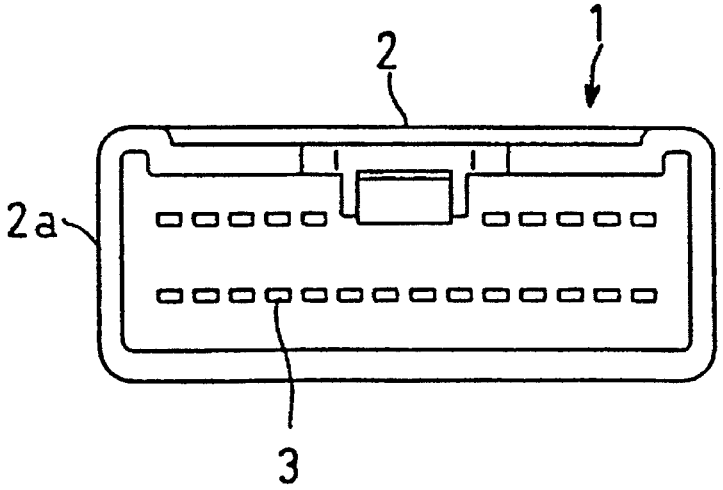
FIG. 7 PRIOR ART
FIG. 7 is a front view of the prior art male connector.
Figure 8:
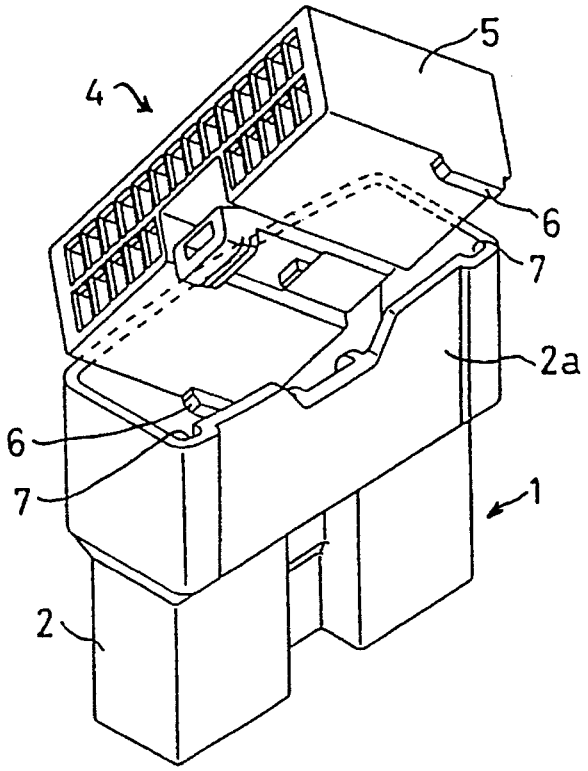
FIG. 8 PRIOR ART
FIG. 8 is a perspective view of the prior art connector when a female connector is obliquely inserted into a receptacle.

Contrary to the prior art, even if the receptacle 24 of the subject invention is forcibly pressed to open wider by the misaligned female connector housing 12, the leading end of the female connector housing 12 comes into contact with the stepped portions 28 formed in the inner wall surfaces of the receptacle 24, thereby blocking further entry of the female connector housing 12 (FIGS. 4 and 5). Since the stepped portions 28 are between the opening edge 24*a* of the receptacle 24 than the male terminals 23. Therefore deformation of the male terminals 23 due to contact of the female connector housing 12 is not possible.

According to this embodiment, the female connector housing 12 can be inserted into the receptacle 24 only when it is held in a proper posture with respect to the receptacle 24. Therefore, erroneous insertion of the female connector 10 can be securely prevented. Further, even if the female connector housing 12 in its improper posture is forcibly inserted into the receptacle 24, it comes into contact with the stepped portions 28 of the receptacle 24 and thereby any further entry into the receptacle 24 is prevented. Thus, deformation of the male terminals 23 can also be securely prevented.

The invention is not limited to the foregoing embodiment, but may be embodied, for example, in the following manners. These embodiments are also embraced by the scope of the invention.

(1) In the foregoing embodiment, a projection is formed by forming the stepped portions 28 in the receptacle 24. Instead of the stepped portions 28, for example, a multitude of ribs extending in the longitudinal direction of the male terminals 23 may be formed on the inner wall surface of the receptacle 24. These ribs act as projections with which the obliquely inserted female connector housing comes into contact.

(2) In the foregoing embodiment, a multitude of male terminals of identical shape are mounted in the receptacle 24. However, for example, large size male terminals and small size male terminals can be mixed, e.g., large size male terminals having a large conductance may be mounted at opposite lateral sides of the receptacle 24 and small size male terminals having a small conductance may be mounted in an intermediate portion of the receptacle 24.

What is claimed is:

1. An electrical connector comprising:

a male connector (20) having a male connector housing (22) with an opening edge (24*a*), a rear wall 24*b*) and a receptacle (24) formed therebetween, a plurality of male terminals (23) being mounted in the male connector housing (22) and projecting from the rear wall (24*b*) and into portions of the receptacle (24) between the rear wall 24(*b*) and the opening edge (24*a*), said male connector housing (27) having a guide groove (27) formed in the receptacle (24) thereof and a female connector (10) having a female connector housing (12), which is dimensioned to be inserted into the receptacle (24) of the male connector housing (22) when said male and female connector housings (22 and 12) are in a specified alignment relative to one another, and wherein at least one rib (15) projects from the female connector housing (12) to prevent erroneous insertion of the female connector housing (12) into the male connector housing (22), and said guide groove (27) formed in the receptacle (24) is suitable for guiding the rib (15) when the female connector housing (12) is inserted into the receptacle (24) of the male connector housing (22) in a longitudinal mating direction wherein:

steps (28) being formed in the receptacle (24) of the male connector housing (22) at locations intermediate the male terminals (23) and the opening edge (24*a*), said steps (28) being formed in opposed inner wall surfaces of the receptacle (24), each of said steps (28) being extended in longitudinal and transverse directions with respect to said mating directions, such that portions of said receptacle (24) between said steps (28) and said rear wall (24*b*) define smaller cross-sectional dimensions than portions of said receptacle (24) between said steps (28) and said opening edge (24*a*) so that an obliquely inserted female connector housing (12) comes into contact with said steps (28) thereby preventing said obliquely inserted female connector housing (12) from damaging said male terminals (23).

2. An electrical connector according to claim 1, wherein one of said steps (28) is opposed to the inner wall surface in which the guide groove (27) is formed.

3. An electrical connector comprising:

a female connector having a generally rectangular female connector housing including substantially parallel top and bottom walls and substantially parallel lateral side walls extending between said top and bottom walls, said top and bottom walls defining a selected minor height for said female connector housing and said lateral side walls defining a selected width for said female connector housing, at least one rib projecting upwardly beyond said top wall of said female connector housing and defining a major height thereof; and a male connector housing having a rear wall, spaced apart top and bottom walls projecting forwardly from said rear wall to an opening edge of said male connector housing, spaced apart side walls projecting forwardly from said rear wall to said opening edge, such that said top and bottom walls and said side walls of said male connector housing define a receptacle extending from said opening edge to said rear wall, said top wall being formed to define a groove disposed and dimensioned to receive the rib of said female connector housing, a plurality of male terminals mounted in said male connector housing and projecting in a longitudinal mating direction with said female connector form the rear wall thereof to a location intermediate said rear wall and said opening edge, said male connector having steps, each of said steps formed on said top and bottom walls at a location spaced from said opening edge and from said male terminals, said steps extending longitudinally and transversely with respect to said mating direction said steps defining a receptacle height greater than said minor height of said female connector housing and less than the major height of said female connector housing, such that said steps permit a properly aligned female connector housing to be inserted into said receptacle and prevent an improperly aligned female connector housing from being inserted sufficiently into said receptacle for contacting said male terminals.

4. An electrical connector as in claim 3, wherein a transverse portion of each of said step extends substantially parallel to said opening edge.

* * * * *